US008764940B2

(12) United States Patent
Espinosa et al.

(10) Patent No.: US 8,764,940 B2
(45) Date of Patent: Jul. 1, 2014

(54) EMBOSSED FIBROUS STRUCTURES

(71) Applicant: The Procter & Gamble Company, Cincinnati, OH (US)

(72) Inventors: Stacey Ann Espinosa, Cincinnati, OH (US); Cathy Marie Sanders, Cleves, OH (US); Nakomi Lee Feldman, Cincinnati, OH (US); Angela Michelle Roberts, West Chester, OH (US); Marion Janet Lopez Fernandez, West Chester, OH (US); Jeffrey Glen Sheehan, Cincinnati, OH (US); Katherine Hope Poli, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/911,245

(22) Filed: Jun. 6, 2013

(65) Prior Publication Data

US 2013/0327487 A1 Dec. 12, 2013

Related U.S. Application Data

(60) Provisional application No. 61/657,395, filed on Jun. 8, 2012.

(51) Int. Cl.
*D21H 27/02* (2006.01)

(52) U.S. Cl.
USPC ..... 162/141; 162/125; 162/127; 162/123; 162/117

(58) Field of Classification Search
USPC ..... 162/362, 117, 141, 125, 127
See application file for complete search history.

(56) References Cited

U.S. PATENT DOCUMENTS 6,165,319 A 12/2000 Heath et al.

(Continued)

FOREIGN PATENT DOCUMENTS

WO WO 00/73585 A1 12/2000

OTHER PUBLICATIONS

International Search Report mailed Oct. 9, 2013 (P&G Case 12508).

*Primary Examiner* — Jacob Thomas Minskey
(74) *Attorney, Agent, or Firm* — Roddy M. Bullock

(57) ABSTRACT

A rolled web of cellulosic paper. The rolled web having a machine direction and a cross direction, the rolled web comprising at least two visually distinct repeating emboss patterns of machine direction oriented embossments. Each the repeating emboss pattern comprise a first region comprising a first emboss design and a first width; a second region comprising a second emboss design and a second width; and a third region disposed between and contiguous with the first and second regions, the third region comprising a third emboss design and a third width. Each of the repeating emboss patterns have a repeat pattern width, the repeat pattern width being measured in the cross direction of the rolled web, the repeat pattern width being the sum of the first, second, and third widths of the repeating emboss pattern. Each of the repeating emboss patterns are parallel and separated from each other of the repeating emboss patterns in the cross direction, the separation being by a fourth region having a fourth width in the cross direction, the fourth width being greater than the pattern width.

20 Claims, 11 Drawing Sheets

(56) References Cited

U.S. PATENT DOCUMENTS

| | | | | |
|---|---|---|---|---|
| 6,200,419 | B1 | 3/2001 | Phan | |
| 6,277,466 | B1 | 8/2001 | McNeil et al. | |
| 6,475,346 | B2 * | 11/2002 | Lefebvre Du Grosriez | 162/362 |
| 8,236,135 | B2 | 8/2012 | Prodoehl et al. | |
| 2008/0087395 | A1 * | 4/2008 | Prodoehl et al. | 162/125 |
| 2009/0297775 | A1 | 12/2009 | Spritzer et al. | |
| 2010/0230059 | A1 | 9/2010 | Santiago et al. | |

* cited by examiner

EMBOSSED FIBROUS STRUCTURES

FIELD OF THE INVENTION

The present invention relates to fibrous structures and more particularly to embossed fibrous structures comprising zones of embossment, processes for making such fibrous structures and sanitary tissue products comprising such fibrous structures.

BACKGROUND OF THE INVENTION

Absorbent fibrous structures, such as absorbent paper products are used for a variety of purposes and are commonly sold as bath tissue, facial tissue, table napkins and paper towels. Absorbent paper products are often embossed for aesthetic as well as functional purposes. Embossments can add visually distinct features to change the overall appearance of the paper product.

Absorbent paper products are disposable articles. In some cases the disposable paper product has a durable counterpart that can also be used for similar functional purposes. For example, facial tissue or cloth handkerchiefs can be utilized for facial needs. Likewise, table napkins can be paper or cloth. Further, in the kitchen one can use a cloth towel or a paper towel for many of the same purposes, as the two implements can have overlapping functions.

Consumers like the look and feel of cloth, but they like the convenience of disposable paper for absorbent products for use in the home. Due to the woven nature of cloth, cloth towels, dishcloths, napkins and the like can be made with visually distinct features such as sewn or printed border features and other designs, many of which are traditionally connected to cloth towels.

There is thus a continuing unmet need for a paper product that visually appears more cloth like.

Additionally, there is a continuing unmet need for a paper product, such as a paper towel, that appears visually more like its cloth counterpart, such as a dish cloth.

SUMMARY OF THE INVENTION

A rolled web of cellulosic paper is disclosed. The rolled web having a machine direction and a cross direction, the rolled web comprising at least two visually distinct repeating emboss patterns of machine direction oriented embossments. Each the repeating emboss pattern comprise a first region comprising a first emboss design and a first width; a second region comprising a second emboss design and a second width; and a third region disposed between and contiguous with the first and second regions, the third region comprising a third emboss design and a third width. Each of the repeating emboss patterns have a repeat pattern width, the repeat pattern width being measured in the cross direction of the rolled web, the repeat pattern width being the sum of the first, second, and third widths of the repeating emboss pattern. Each of the repeating emboss patterns are parallel and separated from each other of the repeating emboss patterns in the cross direction, the separation being by a fourth region having a fourth width in the cross direction, the fourth width being greater than the pattern width.

DETAILED DESCRIPTION OF THE INVENTION

Definitions

Figure 1:
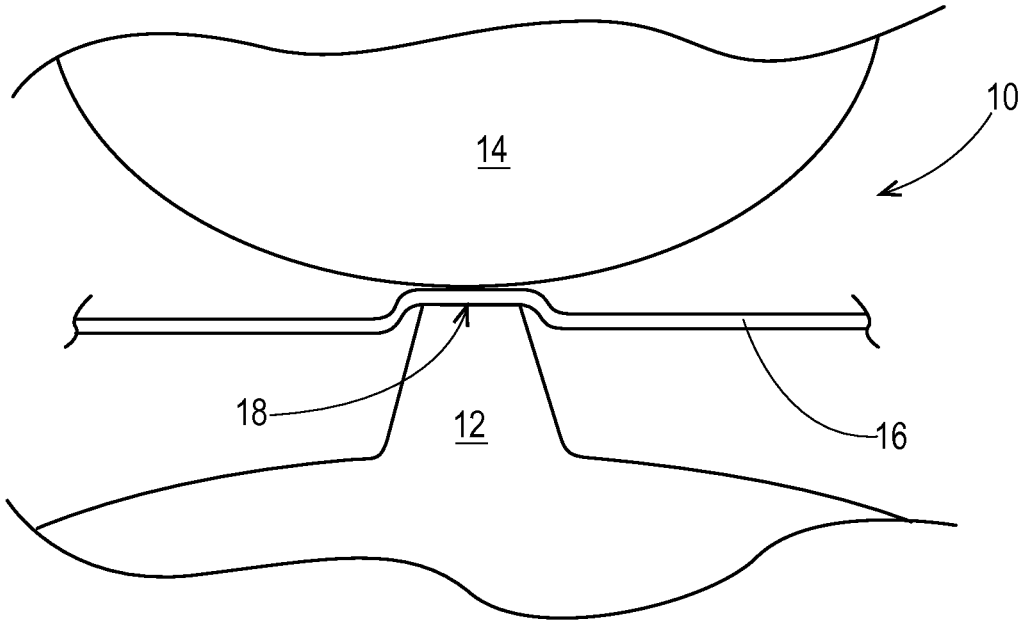
FIG. 1 is a partial, exploded schematic representation of a rubber-to-steel embossing operation useful for making the present invention.

"Fibrous structure" as used herein means a structure that comprises fibers. A nonlimiting example of a fibrous structure of the present invention is an absorbent cellulosic paper product.

Nonlimiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

The fibrous structure of the present invention may exhibit a basis weight between about 10 g/m2 to about 120 g/m2 and/or from about 15 g/m2 to about 110 g/m2 and/or from about 20 g/m2 to about 100 g/m2 and/or from about 30 to 90 g/m2. In addition, the fibrous structure of the present invention may exhibit a basis weight between about 40 g/m2 to about 120 g/m2 and/or from about 50 g/m2 to about 110 g/m2 and/or from about 55 g/m2 to about 105 g/m2 and/or from about 60 to 100 g/m2. Cellulosic paper products can have a basis from about 12 to 52 lbs per 3000 square feet, or from about 24 to 40 lbs per 3000 square feet, or from about 28-33 lbs per 3000 square feet, or from about is 36-50 lbs per 3000 square feet.

The fibrous structure of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the fibrous structure of the present invention may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the fibrous structure exhibits a total dry tensile strength of less than about 394 g/cm (1000 g/in) and/or less than about 335 g/cm (850 g/in).

In another example, the fibrous structure of the present invention may exhibit a total dry tensile strength of greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 315 g/cm (700 g/in) to about 1968 g/cm (5000 g/in) and/or from about 354 g/cm (800 g/in) to about 1181 g/cm (4000 g/in) and/or from about 354 g/cm (900 g/in) to about 984 g/cm (3000 g/in) and/or from about 394 g/cm (1200 g/in) to about 787 g/cm (3000 g/in) and/or from about 1750 g/in to about 2800 g/in. For cellulosic paper products, total dry tensile can range from 2234-2747 g/in, or from 1283-2544 g/in, or from 1247-2617 g/in, or from 1833-2302 g/in, or from 1488-2585 g/in, or from 1250-1650 g/in, or from at least 750 g/in and higher; or up to 2700 g/in. Total dry tensile strength is the sum of MD dry tensile strength and the CD dry tensile strength as measured by tensile test methods known in the art for measuring tissue and towel paper products using a 1 inch width test strip.

The fibrous structure of the present invention may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in). For cellulosic paper products, total wet tensile can be from about 8 g/in, to about 100 g/in. Total wet tensile is the sum of MD wet tensile strength and the CD wet tensile strength as measured by tensile test methods known in the art for measuring tissue and towel paper products using a 1 inch width test strip, which methods include the "finch cup" method.

The fibrous structure of the present invention may exhibit an initial total wet tensile strength of greater than about 118 g/cm (300 g/in) and/or greater than about 157 g/cm (400 g/in) and/or greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The fibrous structure of the present invention may be in the form of fibrous structure rolls. Such fibrous structure rolls may comprise a plurality of connected, but perforated sheets of fibrous structure, that are separably dispensable from adjacent sheets. In one example, one or more ends of the roll of fibrous structure may comprise an adhesive and/or dry strength agent to mitigate the loss of fibers, especially wood pulp fibers from the ends of the roll of fibrous structure. The fibrous structure of the present invention can also be in a cut and/or folded format as is commonly used for facial tissues.

The fibrous structure of the present invention may comprise one or more additives such as softening agents, temporary wet strength agents, permanent wet strength agents, bulk softening agents, lotions, silicones, wetting agents, latexes, especially surface-pattern-applied latexes, dry strength agents such as carboxymethylcellulose and starch, inks, dyes, and other types of additives suitable for inclusion in and/or on fibrous structure.

The fibrous structures of the present invention may be homogeneous or may be layered. If layered, the fibrous structures may comprise at least two and/or at least three and/or at least four and/or at least five layers.

The fibrous structures of the present invention may be co-formed fibrous structures. "Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Fiber" as used herein means an elongate particulate having an apparent length greatly exceeding its apparent width, i.e. a length to diameter ratio of at least about 10. For purposes of the present invention, a "fiber" is an elongate particulate as described above that exhibits a length of less than 5.08 cm (2 in). Nonlimiting examples of fibers include wood pulp fibers and synthetic staple fibers such as polyester fibers.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In addition to the various wood pulp fibers, other cellulosic fibers such as cotton linters, rayon, lyocell and bagasse can be used in this invention. Other sources of cellulose in the form of fibers or capable of being spun into fibers include grasses and grain sources.

"Basis Weight" as used herein is the weight per unit area of a sample reported in lbs/3000 ft2 or g/m2.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multiply fibrous structure and/or multi-ply sanitary tissue product. It is also contemplated that an individual, integral fibrous structure can effectively form a multi-ply fibrous structure, for example, by being folded on itself.

As used herein, the articles "a" and "an" when used herein, for example, "an anionic surfactant" or "a fiber" is understood to mean one or more of the material that is claimed or described.

"Embossing" refers to a type of paper finish obtained by mechanically impressing a design on the finished paper with engraved metallic rolls or plates in combination with complimentary or mating metallic, cross-linked rubber, or soft rubber or rubber-like rolls. Embossing is common in the papermaking industry, particularly in the manufacture of paper towels, toilet tissue, and the like, and embossing as used herein refers to this type of embossing and known methods and processes for such embossing.

"Laminating" refers to the process of firmly uniting superposed layers of paper with or without adhesive, to form a multi-ply sheet. Multi-ply sheets are common in the papermaking industry, particularly in the manufacture of paper towels, toilet tissue, and the like, and laminating as used herein refers to this type of laminating and known methods and processes for such laminating.

Unless otherwise noted, all component or composition levels are in reference to the active level of that component or composition, and are exclusive of impurities, for example, residual solvents or by-products, which may be present in commercially available sources.

The paper of the present invention can be a consumer paper product such as paper towels, toilet tissue, facial tissue, napkins, and the like. In an embodiment, the paper is a paper towel and is comprised of one or more plies of paper. As described below, the paper has embossments. Embossments refer to regions in the paper which have been subjected to densification or are otherwise compacted or deformed out of the plane of the unembossed paper. The fibers comprising the paper in the embossments may be permanently and more tightly bonded together than the fibers in the regions of the paper intermediate the embossments. The embossments may be glassined. The embossments are preferably distinct from one another, although if desired, the embossments may form an essentially continuous network. The embossments of the paper are deflected out of the plane of the paper by the protuberances of the embossing roll.

A single ply of paper may be embossed on one side or both sides. Likewise, if two or more plies are joined together in a face-to-face relationship to form a laminate, either ply can be embossed on one or both sides of each respective ply.

Suitable means of embossing include but are not limited to those disclosed in U.S. Pat. No. 3,323,983 issued to Palmer on Sep. 8, 1964; U.S. Pat. No. 5,468,323 issued to McNeil on Nov. 21, 1995; U.S. Pat. No. 5,693,406 issued to Wegele et al. on Dec. 2, 1997; U.S. Pat. No. 5,972,466 issued to Trokhan on Oct. 26, 1999; U.S. Pat. No. 6,030,690 issued to McNeil et al. on Feb. 29, 2000; and U.S. Pat. No. 6,086,715 issued to McNeil on Jul. 11, 2000; U.S. Pat. No. 7,435,313 issued to Boatman et al. on Oct. 14, 2008; U.S. Pat. No. 7,524,404 issued to Boatman et al. on Apr. 28, 2009; U.S. Pat. No. 8,083,893 issued to Boatman et al. on Dec. 27, 2011; U.S. Pat. No. 7,413,629 issued to Fisher et al. on Aug. 19, 2008; U.S. Pat. No. 7,435,313 issued to Fisher et al. on Aug. 19, 2008; U.S. Pat. No. 8,088,471 issued to Spitzer et al on Jan. 3, 2012, the disclosures of which are incorporated herein by reference.

Suitable means of laminating the plies include but are not limited to those methods disclosed in commonly assigned U.S. Pat. No. 6,113,723 issued to McNeil et al. on Sep. 5, 2000; U.S. Pat. No. 6,086,715 issued to McNeil on Jul. 11, 2000; U.S. Pat. No. 5,972,466 issued to Trokhan on Oct. 26, 1999; U.S. Pat. No. 5,858,554 issued to Neal et al. on Jan. 12, 1999; U.S. Pat. No. 5,693,406 issued to Wegele et al. on Dec. 2, 1997; U.S. Pat. No. 5,468,323 issued to McNeil on Nov. 21, 1995; U.S. Pat. No. 5,294,475 issued to McNeil on Mar. 15, 1994; the disclosures of which are incorporated herein by reference.

The paper of the present invention may comprise cellulosic fibers, non-cellulosic fibers, or a combination of both. The substrate may be conventionally dried, using one or more press felts. If the paper according to the present invention is conventionally dried, it may be conventionally dried using a felt which applies a pattern to the paper as taught by commonly assigned U.S. Pat. No. 5,556,509 issued Sep. 17, 1996 to Trokhan et al. and PCT Application WO 96/00812 published Jan. 11, 1996 in the name of Trokhan et al., the disclosures of which are incorporated herein by reference.

The paper according to the present invention may also be through air dried. A suitable through air dried substrate may be made according to commonly assigned U.S. Pat. No. 4,191,609, the disclosure of which is incorporated herein by reference.

Preferably, the substrate which comprises the paper according to the present invention is through air dried on a belt having a patterned framework. The belt according to the present invention may be made according to any of commonly assigned U.S. Pat. No. 4,637,859 issued Jan. 20, 1987 to Trokhan; U.S. Pat. No. 4,514,345 issued Apr. 30, 1985 to Johnson et al.; U.S. Pat. No. 5,328,565 issued Jul. 12, 1994 to Rasch et al.; and U.S. Pat. No. 5,334,289 issued Aug. 2, 1994 to Trokhan et al., the disclosures of which patents are incorporated herein by reference.

The patterned framework of the belt can imprint a pattern comprising an essentially continuous relatively high density network onto the paper and further has deflection conduits dispersed within the pattern that extend between opposed first and second surfaces of the patterned framework of the belt. The deflection conduits allow discontinuous relatively low density domes to form in the paper. In a like manner, the belt of the present invention can imprint a pattern of high density discrete elements and an essentially continuous relatively low density network, referred to as a continuous "pillow" region. The continuous pillow region can define the discrete, discontinuous relatively high density discrete elements of the paper.

The through air dried paper made according to the foregoing patents can have a plurality of domes formed during the papermaking process which are dispersed throughout an essentially continuous network region (or, alternatively, a plurality of depressions dispersed throughout an essentially continuous pillow region). The domes can extend generally perpendicular to the paper and increase its caliper. The domes can generally correspond in geometry, and during papermaking in position, to the deflection conduits of the belt described above. Alternatively, the knuckles can generally correspond in geometry, and during papermaking in position, to the discontinuous raised cured resin portions of the belt described above. There are an infinite variety of possible geometries, shapes, and arrangements for the deflection conduits and the domes and/or knuckles formed in the paper therefrom. These shapes include those disclosed in commonly assigned U.S. Pat. No. 5,275,700 issued on Jan. 4, 1994 to Trokhan. Examples of these shapes include but are not limited to patterns that can be described as a bow-tie pattern, a fishnet pattern, and snowflake pattern.

The domes protrude outwardly from the essentially continuous network of the paper due to molding into the deflection conduits during the papermaking process. By molding into the deflection conduits during the papermaking process, the regions of the paper comprising the domes are deflected in the Z-direction. For the embodiments described herein, such a paper may have between about 10 to 1000 domes per square inch (i.e.; about 1.55 to 155 domes per square centimeter).

If the paper has domes, or other prominent features in the topography, each embossment in the paper can have an area at least about 0.2 times as great as the area of the dome or other prominent feature in the topography. In general, emboss features can from 19-195% of the size of wet formed features in the paper, or 66% to 195% the size of wet formed features in the paper or up to about 465% the size of wet formed features in the paper.

The paper according to the present invention having domes may be made according to commonly assigned U.S. Pat. No. 4,528,239 issued Jul. 9, 1985 to Trokhan; U.S. Pat. No. 4,529,480 issued Jul. 16, 1985 to Trokhan; U.S. Pat. No. 5,245,025 issued Sep. 14, 1993 to Trokhan et al.; U.S. Pat. No. 5,275,700 issued Jan. 4, 1994 to Trokhan; U.S. Pat. No. 5,364,504 issued Nov. 15, 1985 to Smurkoski et al.; U.S. Pat. No. 5,527,428 issued Jun. 18, 1996 to Trokhan et al.; U.S. Pat. No. 5,609,725 issued Mar. 11, 1997 to Van Phan; U.S. Pat. No. 5,679,222 issued Oct. 21, 1997 to Rasch et al.; U.S. Pat. No. 5,709,775 issued Jan. 20, 1995 to Trokhan et al; U.S. Pat. No. 5,776,312 issued Jul. 7, 1998 to Trokhan et al.; U.S. Pat. No. 5,795,440 issued Aug. 18, 1998 to Ampulski et al.; U.S. Pat. No. 5,900,122 issued May 4, 1999 to Huston; U.S. Pat. No. 5,906,710 issued May 25, 1999 to Trokhan; U.S. Pat. No. 5,935,381 issued Aug. 10, 1999 to Trokhan et al.; and U.S. Pat. No. 5,938,893 issued Aug. 17, 1999 to Trokhan et al., the disclosures of which are incorporated herein by reference.

Several variations in the substrate used for the paper according to the present invention are feasible and may, depending upon the application, be desirable. The paper according to the present invention may be creped or uncreped, as desired. The paper according to the present invention may be layered. Layering is disclosed in commonly assigned U.S. Pat. No. 3,994,771 issued Nov. 30, 1976 to Morgan et al.; U.S. Pat. No. 4,225,382 issued Sep. 30, 1980 to Kearney et al.; and U.S. Pat. No. 4,300,981 issued Nov. 17, 1981 to Carstens, the disclosures of which patents are incorporated herein by reference.

To further increase the soft tactile sensation of the paper, chemical softeners may be added to the paper. Suitable chemical softeners may be added according to the teachings of commonly assigned U.S. Pat. No. 5,217,576 issued Jun. 8, 1993 to Phan; U.S. Pat. No. 5,262,007 issued Nov. 16, 1993 to Phan et al., and U.S. Ser. No. 09/334,150 filed Jun. 16, 1999 in the name of Kelly, the disclosures of which are incorporated herein by reference.

Embossing processes can rely on fibrous structure densification to impart an embossment to the fibrous structure, especially an embossment having an embossment height of greater than 200 μm. Embossing processes can also rely on elongation of the sheet past a plastic point, the plastic strain deformation serving to form the emboss structure. To achieve the densification of the fibrous structure to create the embossment, embossing systems can use a relatively rigid pattern roll (constructed from steel or other metal, hard plastic such as ebonite, or other suitable material) that is loaded against a pressure roll having a deformable surface, such as rubber (referred to as "rubber-to-steel embossing") and/or loaded against a substantially complementary pattern roll (referred to as "matched steel embossing" or male-female embossing"). When a fibrous structure is passed between two such rolls while they rotate, the fibrous structure can be permanently deformed to retain an impressed or indented pattern corresponding to raised elements on the pattern roll.

A typical rubber-to-steel embossing nip 10 created by a steel patterned roll 12 and a rubber pressure roll 14 is illustrated in FIG. 1. The fibrous structure 16 is imparted a densified embossment 18 by the rubber-to-steel embossing nip 10.

Figure 2:
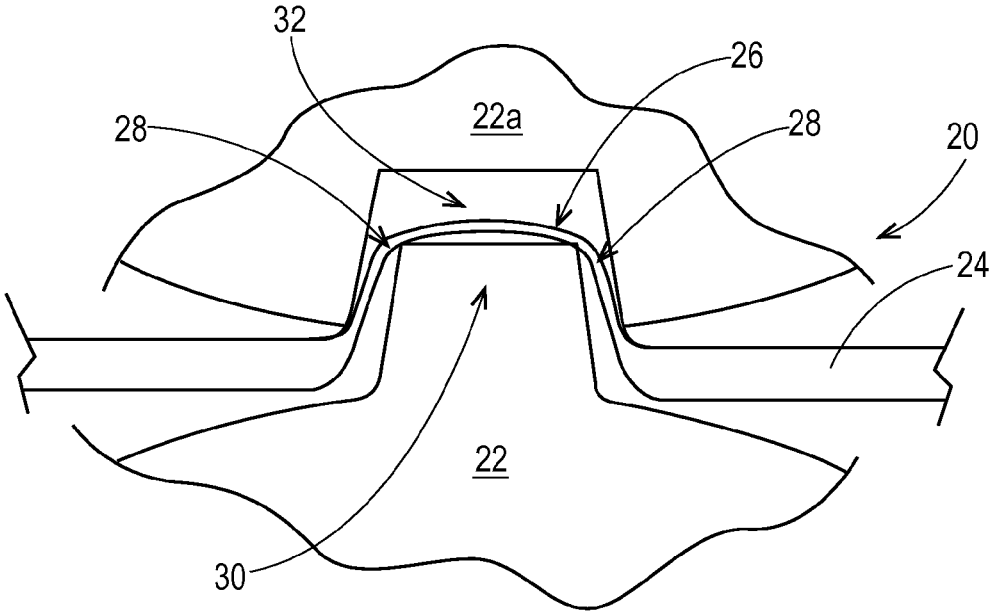
FIG. 2 is a partial, exploded schematic representation of a matched patterned roll embossing operation.

A typical matched patterned roll (such as a matched steel patterned roll) embossing nip 20 created by a first patterned roll 22 and a second substantially complementary patterned roll **22*a* is illustrated in FIG. 2. The fibrous structure 24 is imparted a densified embossment 26, especially at one or more of the edges 28 of the embossment (in the example shown in FIG. 2) where there exists the smallest clearance between a protrusion 30 of the first patterned roll 22 and a recess 32 of the second substantially complementary patterned roll 22*a*. Without wishing to be bound by theory, it is believed that the fibrous structure 24 gets pinched and significantly densified between the protrusion 30 of the first patterned roll 22 and the recess 32 of the second substantially complementary patterned roll 22*a***.

Figure 3:
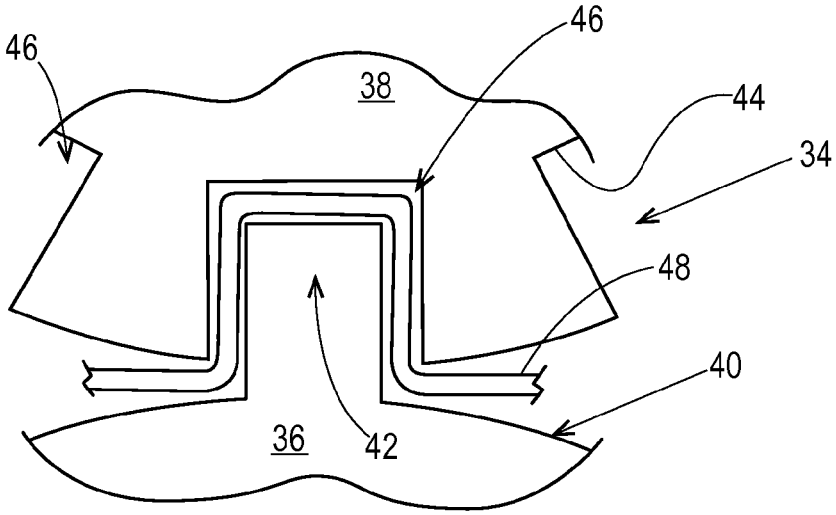
FIG. 3 is a partial, exploded schematic representation of an embossing operation.

As shown in FIG. 3, an embossing operation can comprises an embossing nip 34 comprising a first patterned roll 36 and a second patterned roll 38. The rolls 36 and 38 may comprise complementary or substantially complementary patterns. The first patterned roll 36 comprises a surface 40. The surface 40 may comprise one or more protrusions 42. The second patterned roll 38 comprises a surface 44. The surface 44 may comprise one or more recesses 46. At the embossing nip 34, one or more of the protrusions 42 of the surface 40 mesh with one or more of the recesses 46 of the surface 44. A fibrous structure 48 is positioned between one or more of the protrusions 42 of surface 40 and one or more of the recesses 46 of surface 44 at the embossing nip 34 and/or passes through the embossing nip 34 formed by the meshing of the protrusion 42 with the recess 46 during an embossing operation. A more full description of embossing apparatus, method and process can be found in U.S. application Ser. No. 12/185/458, entitled Embossed Fibrous Structures and Methods for Making Same, filed Aug. 4, 2008 in the name of Byrne.

When a fibrous structure is present within the embossing nip 34, the nip pressure within the embossing nip 34 results in a deformation force (strain) being applied to the fibrous structure, in all directions including and between the machine and cross machine directions, which may result in an embossment being created in the fibrous structure. In one example, the fibrous structure during the embossing operation is subjected to a strain in all directions including and between the machine and cross machine directions such that the fibrous structure experiences a maximum and a minimum strain that differs by less than 25% across all directions.

In one embodiment, embossing is achieved by the embossing process disclosed in U.S. Pat. No. 7,314,663, issued to Stelljes et al. on Jan. 1, 2008. In this process, adhesive is applied to a first fibrous structure in a pattern corresponding to the pattern on a first patterned roll used for embossing. The first fibrous structure is then bonded to a second fibrous structure by passing the first fibrous structure and the second fibrous structure between the first patterned roll and a marrying roll. The bonded fibrous structure is then passed between the first patterned roll and a second substantially complementary patterned roll. The embossments produced by this process can be non-densified.

The embossed multi-ply fibrous structure product according to the present invention comprises two or more plies of fibrous structure that are bonded together along their adjacent surfaces by an adhesive. The adhesive may cover less than about 30% and/or from about 0.1% to about 30% and/or from about 3% to about 30% and/or from about 5% to about 25% and/or from about 5% to about 20% of the bonded adjacent surfaces. The adhesive may be applied to one or more of the plies of fibrous structure in a continuous and/or discontinuous network pattern, such as separate, discrete dots and/or separate, discrete stripes.

In one embodiment of the present invention, the embossed multi-ply fibrous structure can exhibit a plybond strength of at least about 4 g/in and/or at least about 5 g/in and/or at least about 6 g/in as measured by the Plybond Strength Test Method described herein.

Fibrous Structure

The fibrous structure of the present invention comprises a plurality of embossments. The embossments may comprise discrete "point" or "dot" embossments and/or line element embossments. The dot embossments in the fibrous structure of the present invention may be any desired shape, for example circles, ellipses, squares, triangles. The line element embossments may be of any width, length, radius of curvature.

At least one of the embossments in the fibrous structure of the present invention may exhibit an embossment height of greater than about 200 μm and/or greater than about 400 μm and/or greater than about 500 μm and/or greater than about 600 μm and/or greater than about 1000 μm and/or from about 200 μm to about 2500 μm and/or from about 250 μm to about 2000 μm and/or from about 300 μm to about 1500 μm and/or from about 400 μm to about 1500 μm as measured by the Embossment Height Test Method described herein.

The fibrous structure of the present invention may exhibit a flexural rigidity of less than about 15 cm and/or less than about 8 cm and/or less than about 6 cm and/or to about 1 cm and/or to about 3 cm as measured according to the Flexural Rigidity Test Method described herein in either Machine Direction (MD) or Cross Machine Direction (CD).

In one example, the fibrous structure of the present invention may comprise a softening agent. In another example, the fibrous structure of the present invention may comprise a temporary wet strength agent and/or a permanent wet strength agent. Other suitable additives known to those skilled in the art may also be included in and/or on the fibrous structure of the present invention.

Process for Making an Embossed Fibrous Structure

An embossed fibrous structure of the present invention may be made by passing a fibrous structure, previously embossed or unembossed, through an embossing nip formed by two or more rolls, at least one of which is a patterned roll that imparts one or more embossments into the fibrous structure. In one embodiment, the emboss pattern is imparted by conventional rubber-to-steel embossing. In another embodiment, the emboss pattern is imparted by strain induced by the engagement of two pattern rolls, without substantial pressure, as disclosed, for example, in U.S. Pat. No. 7,435,313. In another embodiment, the fibrous structure is conditioned with steam before embossing as disclosed, for example, in U.S. Pat. No. 7,413,629.

The embossment made in the fibrous structure via this process may be a dot embossment and/or a line element embossment.

The embossing operation of the process of the present invention and embossments made in the fibrous structure of the present invention may be phase registered with other features imparted in the fibrous structure, included perforations and printed matter.

Non-Limiting Example of Fibrous Structure

A fibrous structure of the present invention can be a single-ply or a multi-ply structure. If multi-ply, one or more of the plies can be non-embossed.

Figure 4:
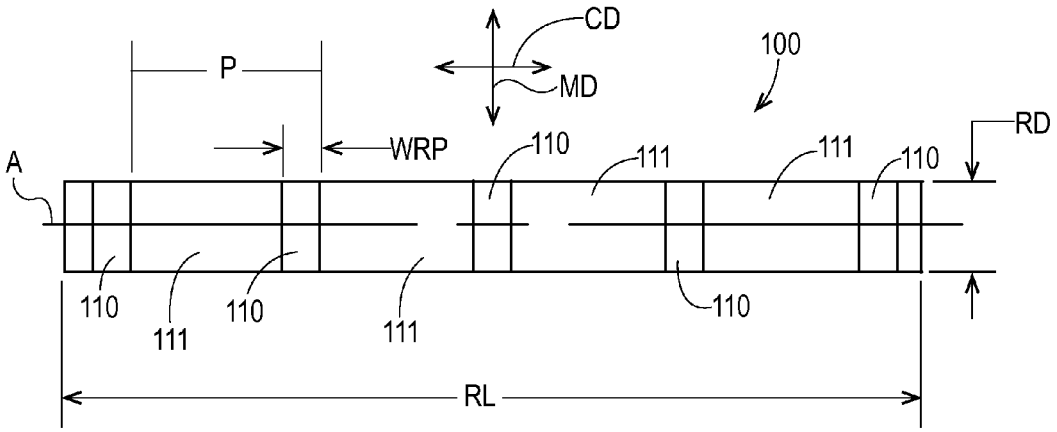
FIG. 4 is a side view of a rolled web of the present invention.

FIG. 4 shows a fibrous structure of the present invention in the form of a rolled web 100. As shown, rolled web 100 has an axis A about which is rolled a quantity of fibrous structure. In an embodiment, fibrous structure is what is known as a "log" of paper suitable for cutting into shorter rolls and sold for use as an absorbent consumer paper product such as paper towels or toilet tissue. As is known in the art, absorbent paper products are made on papermaking machines, rolled onto large diameter parent rolls, which parent rolls are then further converted by being laminated and/or embossed before being rolled onto smaller diameter "log" rolls which are further shortened by cutting to form finished rolls of consumer paper. Thus, the rolled web 100 can be a partially converted absorbent consumer paper product. Partial conversion can include laminating plies and or embossing at least one ply. In an embodiment, rolled web 100 is an embossed, multi-ply cellulosic paper product.

Rolled web 100 can have a roll diameter RD of between about 3 inches and about 8 inches. Rolled web 100 can have a roll length of between about 80 inches to about 120 inches, or about 98 to about 102 inches, or up to about 150 inches.

Rolled web 100 can have at least two repeating emboss patterns 110, the emboss patterns being visually distinct from the regions of paper 111 between emboss patterns 110. By visually distinct can mean that the emboss patterns 110 have a visually distinct difference in the kind of embossments, the density of embossments (emboss elements per area of paper), or the orientation of emboss elements, such that, as a whole, when viewed from about three feet away by the naked eye, each repeating emboss pattern 110 exhibits a visually distinct MD band of embossments.

Figure 5:
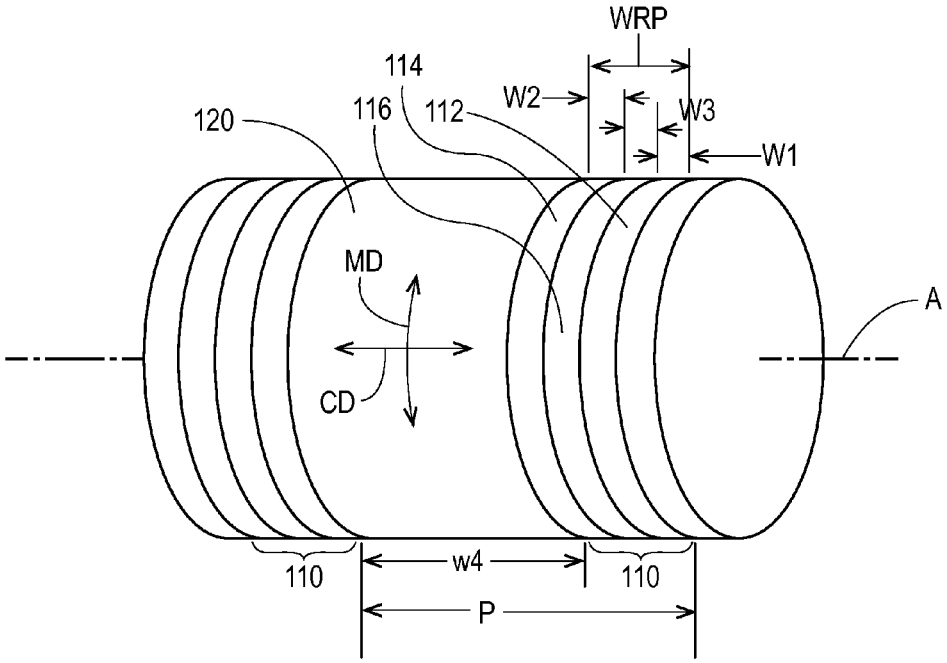
FIG. 5 is a perspective view of a portion of a rolled web of the present invention.

Repeating emboss patterns 110 can be generally band-shaped, the band being oriented parallel to an MD direction of the paper, and can have a repeat pattern width WRP (width, repeat pattern) measured in the CD direction. In an embodiment, each of a plurality of repeating emboss patterns 110 have the same repeat pattern width WRP. Repeating emboss patterns 110 can be spaced apart from one another in the CD by a pitch dimension P, which, as shown in FIGS. 4 and 5, is equal numerically to the distance measured in the CD from a left or right edge of a repeat emboss pattern 110 to the corresponding left or right edge of an adjacent repeat emboss pattern. In an embodiment, repeat pattern width WRP can be from about 1 inch to about 5 inches. In an embodiment, repeat pattern width WRP can be from about 1 inch to about 4 inches. In an embodiment, repeat pattern width WRP can be from about 2 inches to about 3.5 inches. In an embodiment, repeat pattern width WRP can be from about 2.25 inches to about 3.5 inches. In an embodiment, repeat pattern width WRP can be from about 1 inch to about 1.5 inches.

FIG. 5 shows a portion of rolled web 100, and shows two repeating emboss patterns 110. As shown, repeating emboss pattern 110 can have multiple bands, or regions. As shown, repeating emboss pattern 110 has three regions, each region extending longitudinally in an MD direction, with each region being parallel to an adjacent region. A first region 112 can have a first emboss design and a first width W1. A second region 114 can have a second emboss design and a second width W2. A third region 116 can have a third emboss design and a third width W3.

First, second, and third widths can be substantially equal. First, second, and third emboss patterns can be identical. In an embodiment, first and third widths, W1 and W3, are substantially equal, and first and third emboss patterns are substantially identical. In an embodiment, the repeat pattern width WRP is the sum of the first, second, and third widths of the first, second and third regions.

Repeat emboss patterns 110 are separated by a fourth region 120 corresponding substantially to region 111 as shown in FIG. 4, having a fourth width W4. Fourth region can have embossments or it can be emboss-free. Fourth width can be from about 5 inches to about 16 inches measured in the CD direction, and including every ¼ increment between 5 and 16 inches.

As disclosed herein, "widths" of emboss patterns or regions can be determined by measurement, such as with a measuring tape or other physical device providing naked eye visual measure to a resolution of ⅛ inch. That is, widths as measured herein need not be measured by high-resolution means, or with sophisticated equipment such as light microscopes or the like. In general, widths can be measured by placing a ruler orthogonally across the region to be measured and visually determined between the evident edges of a region. By "evident edges" means the visually distinct intended edge of a region. For example, a line 204 of embossments 205 as shown below in FIG. 7, which line 204 can be composed of a generally linearly oriented, or curvilenearly oriented (not shown) series of dot or line embossments 205 delineates an evident edge of, for example, one or more the three emboss regions of repeating emboss pattern 110, as discussed above with respect to FIG. 4. Distance can be, for example, from "center to center" or the like with respect to embossments forming the evident edges of a width to be measured, depending on the type and placement of embossments.

Figure 6:
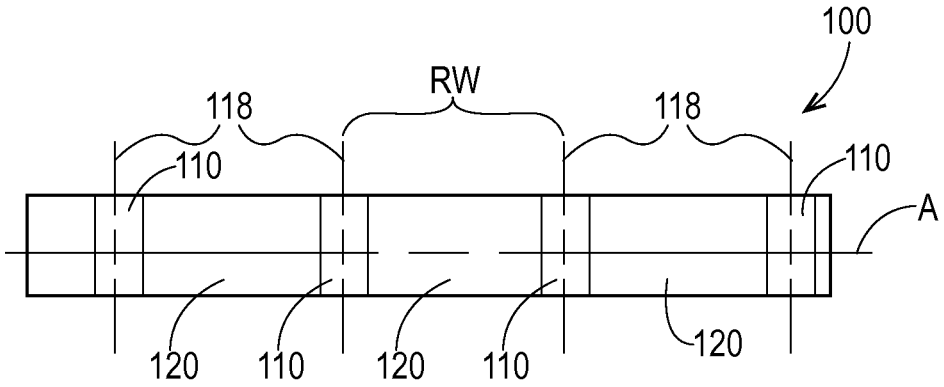
FIG. 6 is a side view of a rolled web of the present invention.

One benefit of a rolled web 100 of the invention is that the rolled web can be cut, such as with a log saw, as is known in the art, to produce a web of paper having visually distinct emboss patterns running in the MD direction. The MD direction patterns can, depending on how the log is cut, be disposed as bands of visually distinct embossments extending in the MD direction along or near each of two outside edges of a finished roll of toilet tissue or paper towels. For example, as shown in FIG. 6, a log saw could saw through rolled web 100 at or near the center 118 of each repeating emboss pattern 110, with two adjacent cuts defining a roll width RW of a finished roll of absorbent paper product, the finished roll having on or near its lateral edges a distinct, MD-oriented "band" of embossed region, which band comprises approximately half of one repeating emboss pattern 110.

As can be understood from the above description, a finished roll of absorbent paper product according to the invention can have on one side edge thereof a band of emboss pattern with an emboss design corresponding to the first region 112, and on the other side edge thereof a band of emboss pattern with an emboss design corresponding to second region 114. The bands of emboss patterns form an edge border of visually distinct emboss patterns on the outermost edge of the finished roll of absorbent paper product, as it was the region cut by the log saws to form the finished roll of absorbent paper product. Alternatively, finished rolls can be formed by slitting the web after embossing but before winding into a log, as is known in the art.

Figure 7:
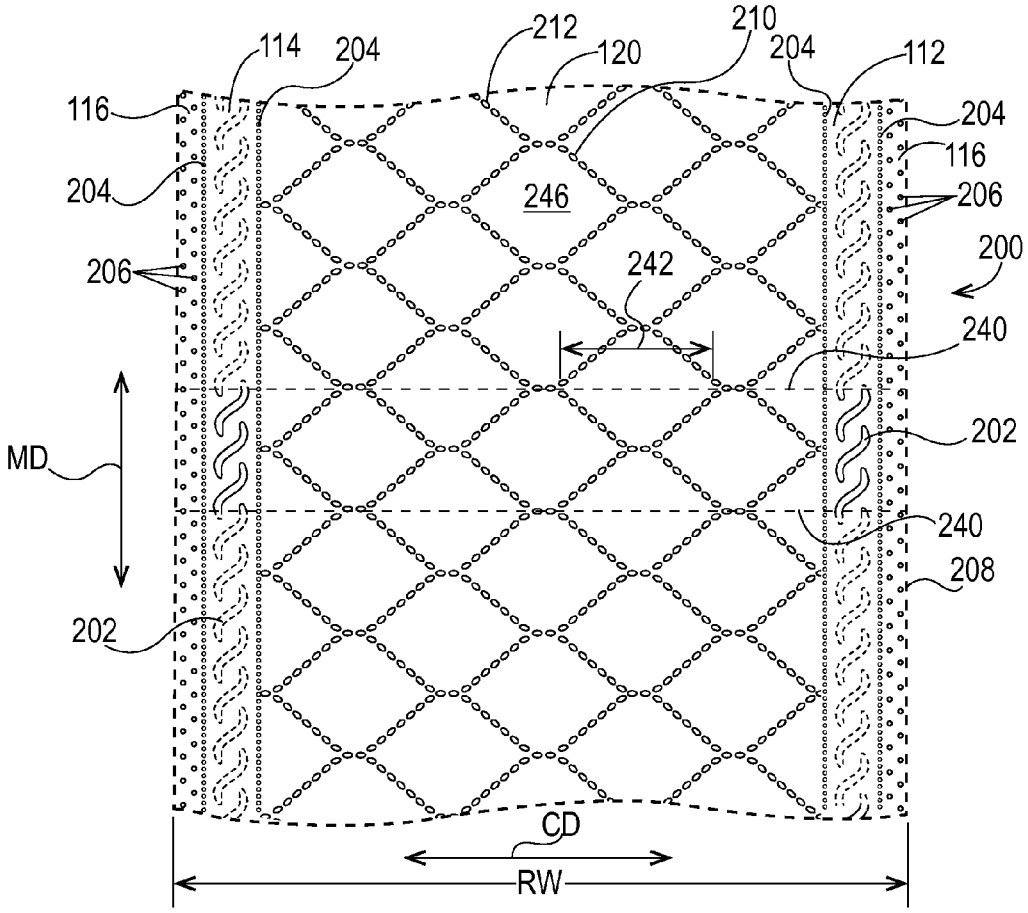
FIG. 7 is a plan view of a portion of a fibrous structure of the present invention.

FIG. 7 shows an example of an embodiment of the invention. A portion of a finished roll of absorbent paper product, which can be a paper towel 200, is shown in FIG. 7. FIG. 7 shows in solid line a repeat unit, which repeat unit can be repeated indefinitely, as indicated by the dashed lines of FIG. 7. As shown, paper towel 200 has a width equal to roll width RW. As is known in the art, paper towel 200 can have periodic, spaced CD-oriented perforation lines 240 to aid in separating individual paper towels from one another.

First region 112 and third second region 114 of paper towel 200 each have a width measured between the evident edges defined by the lines 204 of row embossments 205, and each have identical emboss patterns in the embodiment shown in FIG. 7. In the emboss pattern shown, a series of relatively large S-shaped embosses 202 can give paper towel 200 an appearance associated with kitchen towels, which traditionally have a border element on one or more edges. When disposed within about 25% to about 30% of the paper towel roll width RW away in the CD from edge 208, embosses such as the band of embossments in first region 112 and second region 114, including embosses 202, 205 and 206 can be referred to as a "border emboss." As discussed above, in an embodiment, first region 112 and second region 114 can each be delineated by a line 204 of embossments 205, which line 204 can be composed of a generally linearly oriented, or curvilenearly oriented (not shown) series of dot or line embossments 205.

Third region 116 can have an emboss pattern for which the CD width of the portion of third region 116 on edge 208 of a paper towel 200 is not critical. That is, third region can have embossments that are visually acceptable even if the log saw cuts through region 116 off center. Third region embossments can be formed by relatively small emboss knobs to create embossments having a visual appearance of small, spaced apart emboss impression, or dots 206, as shown in FIG. 7. The number of dots 206 in third region 116 of each paper towel depends on where the cut was made by the log saw in forming the finished roll. Because the plies of multi-ply embodiments can be adhered at the embossments, the embossed relatively small dots 206 can aid in holding the edges 208 of a multi-ply paper towel together. That is, embossed dots 206 tend to tack together two or more plies so that the edges 208 of paper towel 200 to not come apart to an undesirable extent before or during use.

Fourth region 120 can also have an emboss pattern, such as the diamond-shaped emboss pattern 210 shown in FIG. 7. Emboss pattern 210 can be comprised of individual dot or line embossments, such as the generally oval-shaped dot embossments 212 shown in FIG. 7. In an embodiment, as shown in FIG. 7, fourth region 120 can comprise relatively large open areas having no emboss points, such as the relatively large open areas 246 enclosed and defined by a perimeter of consecutively spaced oval-shaped embossments 212.

Of course, other emboss patterns can be utilized for each of the first, second, third, and fourth regions. For some consumers, it is desirable to have a relatively open, low area-density emboss pattern in fourth region 120, and relatively large, deep embossments in first and second regions, 112 and 114, and relatively small embossments in third region 114. In this manner fourth region serves as a "work area" of an absorbent paper product, such as a paper towel, while first and second regions stand out as "border areas" distinguished by the aforementioned border emboss, and providing a distinct visual impression of cloth-like borders on paper towel 200, as well as serving to provide strength to the edge regions (due to the greater ply adhesion at each embossment). The work area of fourth region 120 can be highly absorbent, strong when dry and/or wet, and provide for relatively greater wiping, cleaning, and absorbing properties. The border areas can provide for a visual impression of cloth-like appearance, as well as greater plybond strength due to the higher area density of embossments.

Figure 8:
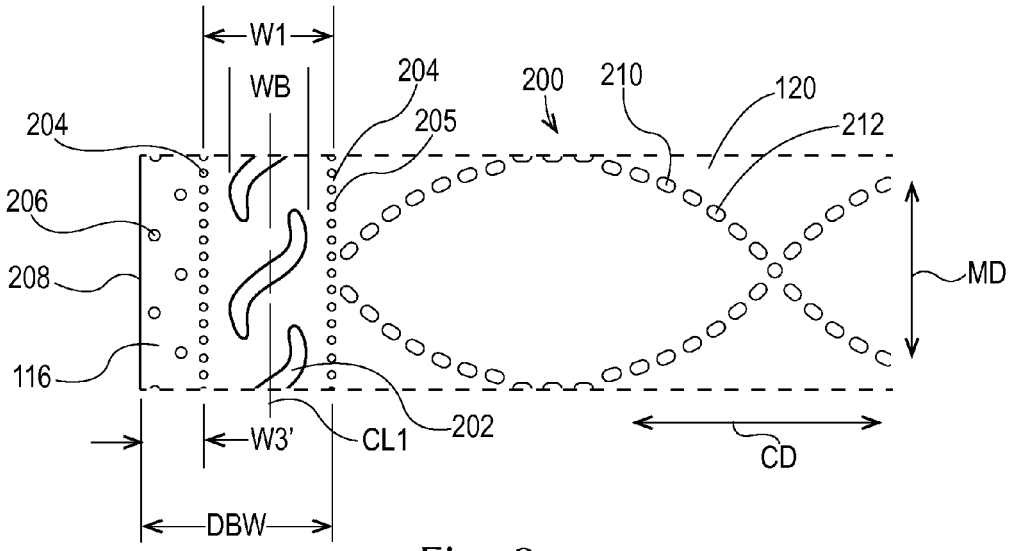
FIG. 8 is a partial plan view of a portion of a fibrous structure of the present invention.

FIG. 8 shows an enlarged view of another embodiment of an emboss pattern for the present invention, which is similar in many respects to the pattern shown in FIG. 7. FIG. 8 shows a portion of an absorbent paper product that can be a paper towel after being cut into a roll by log saws as described above with respect to FIG. 6. Thus edge 208 is one of two lateral edges of a paper towel which borders a portion of third region 116, which region has a width dimension W3' less than width W3, and which can be approximately ½ of W3, with the evident edges of width dimension W3' regions being measured from edge 208 to the centerline of the nearest row 204 of emboss points 205.

As shown in detail in FIG. 8, each of the embossments 202 can be relatively larger in area than other emboss areas, such as those of embosses 205, 206, or 210. In an embodiment, border embossments 202 can have an area at least about 0.008 $in^2$, or from about 0.05 $in^2$ to 0.11 $in^2$, or up to about 0.20 $in^2$. In an embodiment, border embossments 202 can have an area at least 100% or 150% or 200% or 250% or 300% or 350% or 400% or 450% or 500%, 2000% or more greater than any of embosses, 205, 206, 210 or 212. In this manner, certain emboss element, such as embossments 202, can stand out, or "dominate" the visual appearance of paper towel 200, as well as provide significant strength enhancement to border areas of a paper towel.

For every individual embossment area measure, the area of the face of an individual protrusion of a patterned embossing roll, such as protrusion 30 of the first patterned roll 22 shown in FIG. 2, can be calculated and considered to be the area of the embossment produced thereby. In any event, absent instrument or calculated area determinations, a visual comparison of emboss areas on a finished paper towel is sufficient to ensure that one emboss area is at least 100% or more greater than another. That is, the technical feasibility of measuring emboss areas on a paper towel is not considered a barrier to understanding the inventive contribution of relatively large border embossments 202.

Continuing to refer to FIG. 8, region widths in the CD can be measured as described below. First region 112 (or second region 114) has relatively large embossments 202, shown in FIG. 8 as S-shaped embossments. In general, the embossments 202 can have any shape, and can be arranged in the MD direction as periodic embossments along a centerline CL1. An imaginary line inscribed in the MD direction parallel to centerline CL1 and touching the maximum amplitude off of centerline CL1 for embossments 202 can define the evident edges defining a dimension referred to as the border width, WB (as shown, for example, in FIG. 14). Border width can be measured by hand on the finished paper towel to the closest ⅛ inch with a hand measuring instrument, such as a ruler. However, border width WB can also be calculated from the measurements off the patterned roller used in the embossing nip, such as from the machine drawings used to make the patterned roller. This form of measurement holds for all dimensions resulting from embossing herein.

In an embodiment, first region 112 and second region 114 can each be delineated by a line 204 of embossments 205, which line 204 can be composed of a generally linearly oriented, or curvilenearly oriented (not shown) series of dot or line embossments 205. In this embodiment, as shown in FIG. 8, width 1, W1, (for first region 112), or W2, (not shown in FIG. 8, for second region 114) can be measured as the CD direction distance between the center of each line 204 of embossments, as shown in FIG. 8.

As can be understood, once first region 112 width W1 and second region 114 width W2 is established, all other region widths can be determined. For example, region 4 width W4 is the CD dimension of a larger (in area and CD dimension) region between the relevant outside boundaries of regions 112 and 114, and region 3 width W3 is the CD dimension between a smaller (in area and CD dimension) region between the relevant outside boundaries of regions 112 and 114. In a finished roll, a portion of which is shown in FIG. 8, W3' can be the CD dimension between the relevant outside boundaries of regions 112 and the edge 208 of paper towel 200.

In an embodiment not having line 204 embossments, such as one described with respect to FIG. 14 below, border width WB can be equal to width 1, W1, (for first region 112, or W2, for second region 114). That is, an MD direction band of distinctive border can be defined as a band inboard of edges 208 of a paper towel 200 having a width DBW equal to W3' plus W1, wherein W1 includes within it WB or is equal to WB. In general, it is desirable that fibrous structures of the present invention, including paper towels 200, have visually distinct borders on each lateral edge, each having border widths DBW that are equal. In an embodiment, the two visually distinct borders can have border widths DBW that differ in width dimension by less than about 50%, or less than about 40%, or less than about 30%, or less than about 10%, or less than about 5%. In an embodiment, neither border width DBW is greater than about 4.0 inches, or about 3.0 inches, or about 2.5 inches, or 2.0 inches, or 1.5 inches, or 1 inch, or 0.5 inch.

Figure 9:
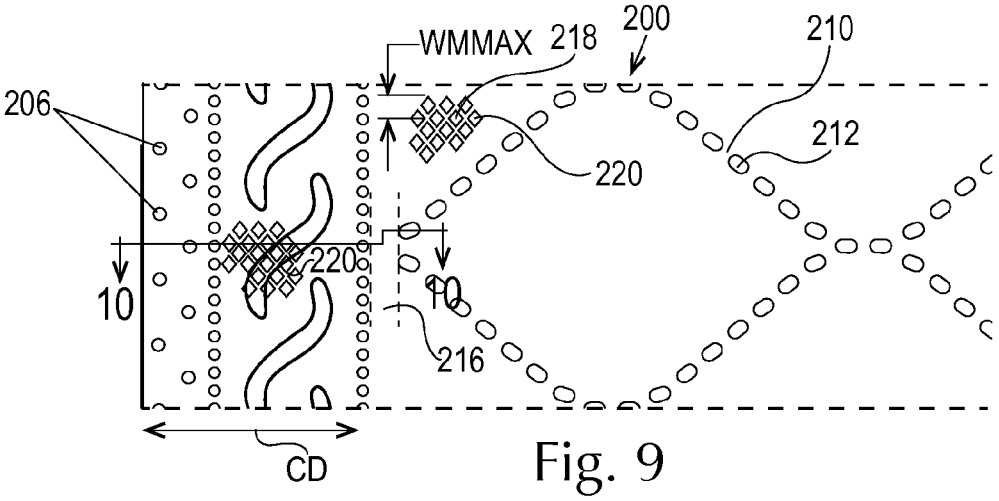
FIG. 9 is a partial plan view of a portion of a fibrous structure of the present invention.

FIG. 9 shows another embodiment of a paper towel of the invention, showing further detail into the various features and benefits of the various regions and emboss patterns. One difference between the paper towel of FIG. 8 and that of FIG. 9 is the spacing noted as MD-oriented zone 216 between the MD-oriented evident edge of embossments 212 of emboss pattern 210, and the MD-oriented line 204 of dot embossments 205. The spacing of oriented zone 216 is defined by an absence of emboss elements; that is, in zone 216 there are no emboss elements identified with either of first regions 112 or 114, or region 111. It is believed this spacing adds to the cloth-like visual impression of border embossments, as well as contributing to beneficial stiffness and flexibility attributes of a paper towel of the invention. In an embodiment, the CD width of zone 216 can be from about ⅛ inch to about ½ inch, including about 3/16 inch, ¼ inch and 5/16 inch.

Figure 10:
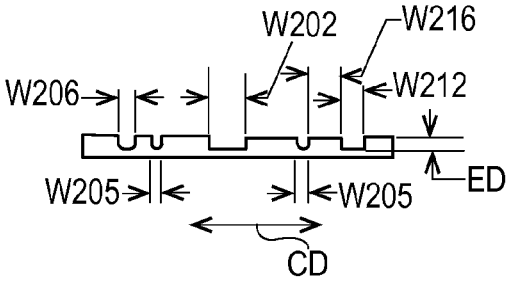
FIG. 10 is a cross section detail of Section 10-10 of FIG. 9.
Figure 11:
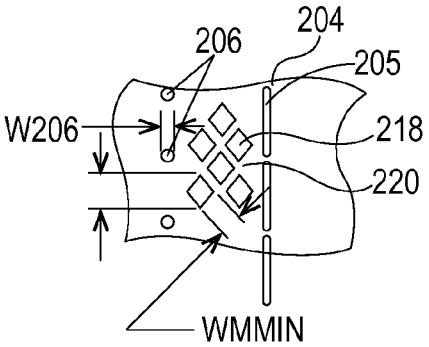
FIG. 11 is partial plan view of a portion of a fibrous structure of the present invention.

FIG. 10 is a cross-sectional view of Section 10-10 of FIG. 9. Section 10-10 runs through each of the embossments described above and together with FIG. 11 is intended to show certain possible dimensional relationships. As shown in FIG. 10, dot embossments 206 can have a dimension W206, which can be a diameter, if circular, or a greatest dimension if irregular. For example, if dot embossments are oval, dimension W206 can be the long axis dimension, and if dot embossments are generally square, dimension W206 can be a diagonal dimension. For other embossments, such as embossments 205 and embossments 212, embossments can have a dimension which is the greatest distance measured in a CD direction. Thus, W205 and W212 are a dimension measured across embossments 205 and 212, respectively, in the CD direction. Likewise, dimension W202 can be a longest distance through embossment 202 in the CD direction, for example, W202 can be 0.10 inches to about 0.30 inches. As before, all emboss dimensions can be determined based on the protrusions, or emboss knobs, of an emboss roll, as well as on paper towel 200.

As can be seen in FIG. 10, one feature of the present invention is that dimension W202 can be significantly longer than any of the other emboss dimensions. In an embodiment, W202 is about 10%, or 25% or 50% or 75% or 100% or 125% or 150% or greater than the next largest dimension of the group consisting of W205, W206 and W212. It is believed that the dimensional difference exhibited by emboss elements 202 contribute to the overall visual impression of paper towel 200, giving it a cloth-like appearance, as well as to an MD-oriented "strength band" providing a paper towel, for example, an increased resistance to tensile failure when tensioned in the MD direction.

In an embodiment, it can be desirable that dot embossments 206 be minimally noticeable to a viewer of a finished paper towel 202. In an embodiment, embossments 206 serve only, or primarily, to tack (or adhere) multiple plies together, and as such the purpose of embossments 206 can be only to bond edges so as to prevent ply delamination at the edges. For this reason, it can be desirable to make embossments having dimensions that blend into, or otherwise become relatively unnoticeable, relative to the texture of the unembossed paper of paper towel 200. For example, as shown in FIG. 9, and in greater detail in FIG. 11, the paper of paper towel 200 can be made by the aforementioned method that uses a patterned framework belt comprising an essentially continuous relatively high density network to imprint a pattern of high density discrete elements 218 in the form of depressions, or a pattern of continuous high density network and discontinuous deflections conduits to form a pattern of low density elements 218 in the form of domes. When paper is made on such a patterned framework belt, depending on the type of patterning of the framework belt, as is known in the art, the finished, unembossed paper can have either domes or depressions, both noted as background texture 220, which is comprised of a plurality of wet-formed texture elements 218 in FIGS. 9 and 11. For simplicity, in the present description, wet-formed texture element 218 will be referred to as a depression, which means that it has some characteristics of an emboss pattern, although it is made during the "wet" portion of the paper making process, and dried prior to further embossing steps. Note also a difference in FIG. 11 which shows line emboss 204 made as a series of elongated oval-shaped embossments 205.

For purposes of the present invention, it is believed important that a greatest dimension WMMAX of elements 218, be greater than dimension W206 of embossments 206. Texture elements 218 can have an irregular, out-of-round, oval, or other shape, such as the elongated diamond shape as shown, in which case there can be a minimum dimension WMMIN, as well as a maximum dimension WMMAX. If is believed that if the dimension of emboss element 206 is smaller than a maximum dimension of element 218, emboss element 206 can get "lost" in the general background patterning effect produced by texture elements 218. In an embodiment, emboss element 206 can be 10% or 20% or 30% or 40% or 50% smaller than a maximum dimension of element 218. In this manner emboss elements 206 are relatively difficult to visually detect, and thus contribute little to the overall visual appearance of paper towel 200.

Figure 12:
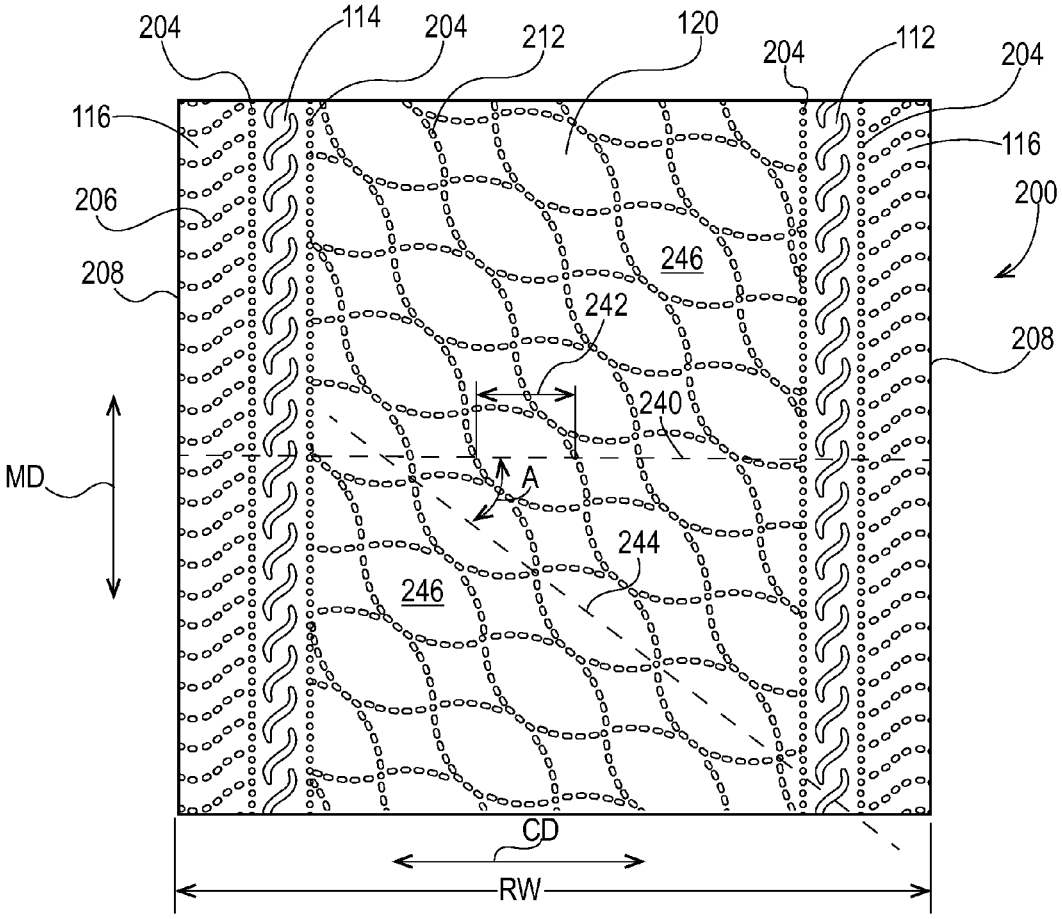
FIG. 12 is a plan view of a portion of a fibrous structure of the present invention.

FIG. 12 shows another embodiment of the invention, showing a portion of a finished roll of an absorbent paper product, which can be a paper towel 200, as shown in FIG. 7. As shown, paper towel 200 has a width equal to roll width RW. As is known in the art, paper towel 200 can have periodic, spaced CD-oriented perforation lines 240 to aid in separating individual paper towels from one another. Paper towel 200 of FIG. 12 is in many respects similar to that shown in FIG. 7, but showing variations in the embossments in third region 116 and in the "work area" fourth region 120. As shown, for example, the emboss pattern of embossments in third region 116 comprise closely spaced point embossments forming an MD-spaced series of generally wavy line patterns. The generally wavy line patterns can be identical and be repeated periodically in a spaced relationship in the MD direction, as shown in FIG. 12. On advantage to having periodically spaced generally wavy line patterns in third region 116 is that there is a higher probability of ensuring a minimal distance between emboss impression points 206 near exposed edge 208, thereby lessening the over distance which delamination of a multi-ply paper towel 200 can occur. The periodic wavy lines can also minimize the visual impression of slightly differing widths, as measured in the CD direction of the two portions of third region 116 exhibited on opposing lateral edges of paper towel 200. Therefore, if a log saw does not cut exactly in the middle of third region 116, the variation is less noticeable.

One drawback to having large, unadhered open areas in fourth region 120, such as the relatively large open areas 246 enclosed and defined by a perimeter of adhered, oval-shaped embossments 212 or generally round embossments, is that after tearing at periodic, spaced CD-oriented perforation lines 240, the exposed edge of multi-ply paper towel 200 can exhibit separation of the plies in the relatively large span between the glue-bonded embossment points 212, which can be a maximum distance indicated, for example, as distance 242 in FIG. 7.

A different emboss pattern for fourth region 120 is shown in FIG. 12. The emboss pattern shown in FIG. 12 is characterized by having a maximum dimension of the relatively large open areas 246 oriented at an angle A off of a line of CD-oriented perforation lines 240. In this manner, as shown in FIG. 12, relatively large open, non-embossed (and unadhered) areas of fourth region 120 can be maintained, while minimizing the maximum distance of potential ply separation, such as indicated by distance 242 in FIG. 12. As can be seen in FIG. 12, distance 242 is a maximum, with other distances between adhered emboss points along a line of CD-oriented perforation lines 240 being shorter than maximum distance 242.

In an embodiment maximum distance 242 can be less than about 2 inches, or less than about 1.5 inches, or less than about 1 inch, or less than 0.75 inch, or less than about 0.5 inch.

In an embodiment, angle A can be from about 10 degrees to about 75 degrees off of perforation line 240, including all increments of 1 degree in between, including, for example, 45 degrees.

In an embodiment, the area of the relatively large open areas 246, measured as being defined by the innermost tangent of emboss points forming the defining perimeter, can be from about 0.5 square inches, or about 0.75 square inches, or about 1.0 square inches, or about 1.25 square inches, or about 2.0 square inches, or about 2.5 square inches, or about 3.0 square inches.

In an embodiment, distance 242 can be about 1%, or about 5%, or about 10%, or about 20%, or about 30%, of total width RW.

Figure 13:
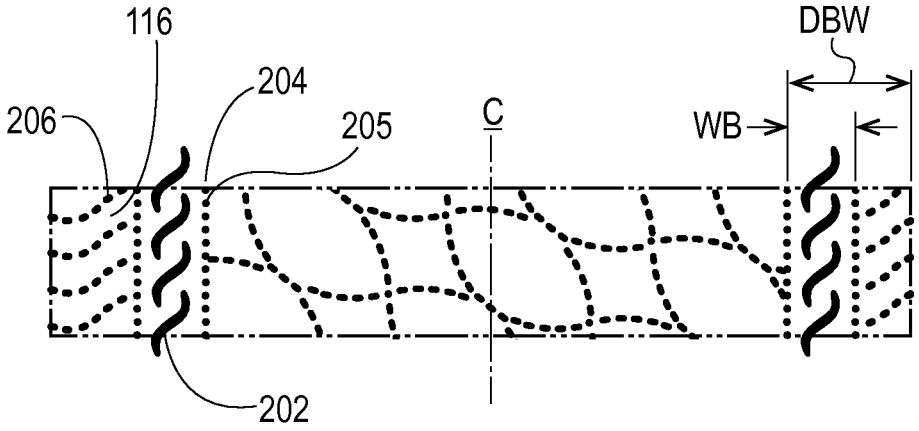
FIGS. 13-15 show non-limiting variations on repeat pattern for emboss designs for fibrous structures of the present invention.
Figure 14:
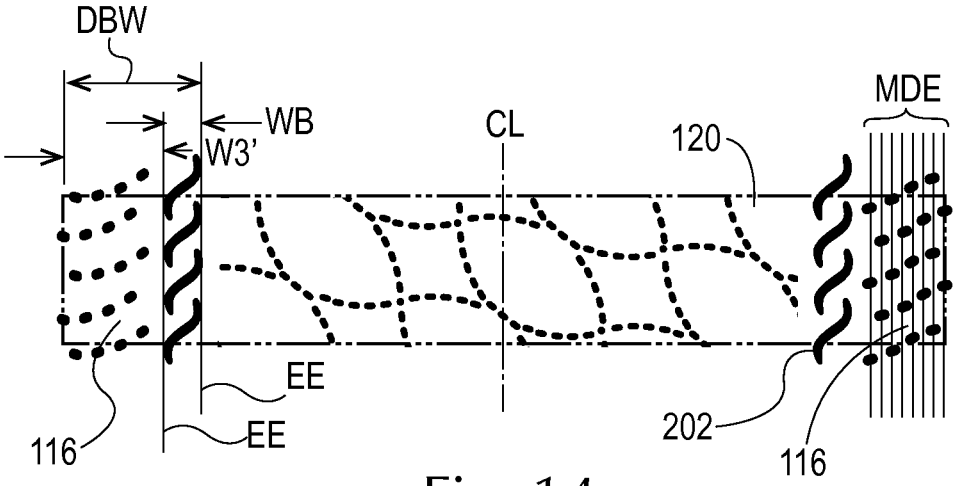
Figure 15:
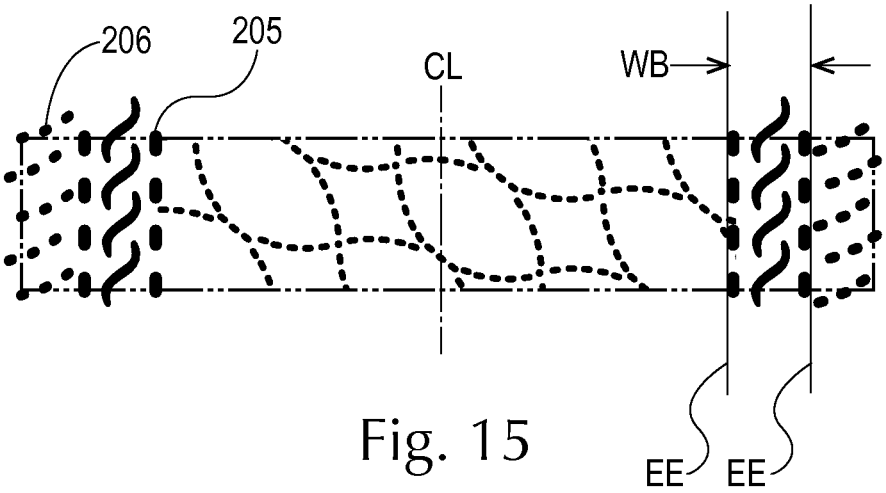

FIGS. 13-15 show non-limiting embodiments of pattern repeats for various emboss patterns showing various modifications primarily to first, second, third regions. As shown in FIG. 13, for example, shows a repeat pattern of an emboss roll for making an embossed paper having the pattern shown in FIG. 12. As shown, dimension DBW, which is the cross directional distance measured from said first roll edge to an inboard edge of said first width can include a first or second region, 112 or 114, having a width WB which can encompass two different size emboss elements (e.g., elements 202 and 205), and a portion of third region 116.

FIG. 14 shows an embodiment of an emboss patterns in which MD direction oriented lines 204 of embossments 205 have been removed, such that the distinctive border width DBW extends to inside edge (also known as inboard edge) of the evident edge EE created by the S-shaped emboss elements. Also, to improve wear life of a soft, e.g., rubber, roll in a mating "steel to rubber" emboss nip roll arrangement, emboss points in third region 116 can be staggered such that for any MD oriented line MDE inscribed through embossments, the number of emboss knobs per linear distance is minimized without sacrificing the overall purpose, function, and visual appearance of embossments, such as in third region 116. For example, as indicated by MD emboss lines MDE in FIG. 14, a maximum of 3 emboss knobs is in the repeat unit (as opposed, for example, to 5 emboss knobs repeated in each MD oriented emboss line in the pattern shown in FIG. 13) can be beneficial. In an embodiment, as shown in FIG. 14, dimension WB, which is the dimension in the cross machine direction between the evident edges defined by the MD oriented, uniformly spaced S-shaped elements, can be 0.488 inches.

FIG. 15 shows another embodiment of an emboss repeat pattern. In every repeat pattern it may be beneficial to vary the height of the emboss knobs on the emboss roll. For example, in FIG. 15, the emboss knobs used to produce embossments 206 can be a different height relative to the emboss knobs used to produce embossments 205. In general, the emboss knobs can be of different heights relative to each other, and can range from an emboss height on the emboss roll from about 0.060 inches to about 0.150 inches, or from about 0.070 inches to about 0.130 inches.

Process for Making Multi-Ply Fibrous Structure

One or more embossed fibrous structures of the present invention may be combined with another fibrous structure, either the same or different, to form a multi-ply fibrous structure.

In one example, a process for making a multi-ply fibrous structure comprises the step of combining an embossed fibrous structure of the present invention with another fibrous structure to form a multi-ply fibrous structure.

In another example, a process for making a multi-ply fibrous structure comprises the steps of:

providing a first embossed fibrous structure according to the present invention;

providing a second fibrous structure;

bonding the first and second fibrous structures together to form a multi-ply fibrous structure.

The second fibrous structure may be an embossed fibrous structure, such as a rubber-to-steel embossed fibrous structure.

The first and second fibrous structures may comprise the same emboss pattern or they may be different.

The bonding step may comprise applying an adhesive to at least one of the fibrous structures. The adhesive may be applied to one or more surfaces of the fibrous structure by any suitable process known to those skilled in the art. Non-limiting examples of suitable processes include smooth applicator roll process, patterned applicator roll, gravure roll application process, slot extrusion, spray process, permeable fluid applicator process and combinations thereof. The adhesive may cover 100% of the surface area of the fibrous structure or some portion of the surface area of the fibrous structure. The less adhesive coverage the less negative impact to softness of the multi-ply fibrous structure. A non-limiting example of a suitable adhesive for use in the processes of the present invention includes polyvinyl alcohol. In one example, the adhesive is a polyvinyl alcohol that has a viscosity at 14% solids of 10,000 centipoise.

An embossed fibrous structure may remain on a first patterned roll as the roll rotates past the embossing nip (not shown). The embossed fibrous structure is typically deformed in the z-direction such that after the emboss nip, fibrous structure zones between embossments are deformed down into the relieved portion of the first patterned roll, leaving only the embossments of the embossed fibrous structure at the outer periphery of the first patterned roll. As the fibrous structure passes an adhesive application zone, such as a smooth applicator roll which operates in conjunction with a gravure roll to supply a uniform thin layer of adhesive to the surface of the smooth applicator roll, adhesive is applied to the embossed fibrous structure at the embossments of the embossed fibrous structure. Typically the adhesive is applied only to the embossments of the embossed fibrous structure and typically all embossments have adhesive applied to them. This approach limits the adhesive in the embossed fibrous structure (better for softness) since the embossed area is usually a small portion of the total embossed fibrous structure and helps retain the embossment clarity by holding down or retaining the embossed fibrous structure deformation at the embossment.

In another example, adhesive is only applied to a portion of the embossments in an embossed fibrous structure—enough to achieve necessary bond strength between two or more combined plies of fibrous structure but low enough to allow movement between the plies in many locations to improve drape and softness impression of the multi-ply fibrous structure. Adhesive application to only a portion of the embossments can be achieved by a patterned applicator roll having raised areas that correspond to a portion of the embossments in the embossed fibrous structure.

In yet another example adhesive is applied to embossments, either all embossments or some portion of each embossment or some portion of embossments or some portion of portion of individual embossments such as only adhesive application at opposite ends of a line element embossment by way of a permeable fluid applicator roll. Holes of the permeable applicator roll may be registered to an emboss pattern on a first patterned roll. The adhesive becomes deliverable to an embossment as the adhesive passes from an interior surface of the permeable applicator roll through hole to an exterior surface of the permeable fluid applicator roll. The permeable fluid applicator roll process can provide a higher volume of adhesive at each adhesive transfer point. The drop of adhesive may also be relatively large compared to the thickness of adhesive on a smooth applicator roll. The higher volume of adhesive, or drop size, also allows a greater operating distance between the permeable fluid applicator roll and patterned roll while still ensuring adequate adhesive transfer to the fibrous structure, thereby minimizing compression on the fibrous structure. A non-limiting example of a suitable permeable fluid applicator roll is described in U.S. Patent Publication No. 2006/0193985 to McNeil et al.

After adhesive is applied to one or more of the fibrous structure plies, the plies are brought into proximity. If a fibrous structure other than the embossed fibrous structure of the present invention is embossed, its emboss pattern is typically complementary to the emboss pattern on the embossed fibrous structure ply of the present invention and is brought into proximity in a registered manner. For example, one fibrous structure ply may have embossments that provide permanently deformed zones that extend upward in the z-direction. When these embossments are registered with embossments of an embossed fibrous structure ply of the present invention, the embossed z-direction embossments in the other ply may provide support for unembossed zones in the embossed fibrous structure ply of the present invention, thus providing a consumer preferred undulating topography that is perceived as soft and pillowy. After the plies are brought into proximity (in a registered manner if desired), the resulting multi-ply fibrous structure is passed through a marrying roll nip.

In another embodiment typical rubber to steel embossing rolls and equipment can be utilized to produce embossments on a fibrous structure of the present invention.

In one example, the embossing and laminating equipment suitable for use in the present invention may be combined into a modular unit such that the modular unit is capable of being inserted into a papermaking machine at a desired location, such as in the converting section of the papermaking machine.

The embossing operation of the present invention and/or laminating process of the present invention can operate at any suitable speed such as greater than about 500 feet per minute (fpm) and/or greater than about 1000 fpm and/or greater than about 1500 fpm and/or greater than about 1800 fpm and/or greater than about 2000 fpm and/or greater than about 2400 fpm and/or greater than about 2500 fpm.

After embossing and, optionally for multi-ply fibrous structures, laminating, the multi-ply fibrous structure can be conveyed to other fibrous structure processing stations such as lotioning, coating, printing, slitting, folding, perforating, winding, tuft-generating, and the like. Alternatively, some of these other fibrous structure processing transformations may occur prior to the embossing and laminating transformations.

After embossing and, optionally for multi-ply fibrous structures, laminating, the embossed fibrous structure can be rolled onto a cardboard tube, as is known for bath tissue and paper towels, to form what is called in the papermaking field a "log". The amount of fibrous structure rolled onto the log can be varied as desired, depending on how much paper is desired to be supplied on finished rolls of product. In general, logs can have a finished diameter of from about 75 mm (about 3 inches) to about 250 mm (about 10 inches).

Test Methods

Unless otherwise indicated, all tests described herein including those described under the Definitions section and the following test methods are conducted on samples, test equipment and test surfaces that have been conditioned in a conditioned room at a temperature of 73° F.±4° F. (about 23° C.±2.2° C.) and a relative humidity of 50%±10% for 12 hours prior to the test. Further, all tests are conducted in such conditioned room.

Average Thickness Test Method

The average thickness measurements for an embossed fibrous structure are measured as follows. A high resolution x-ray tomography system, the Scanco μCT40 (serial #07030700, ID#4286, Scanco Medical AG), is used to visualize and record x-ray absorption of fibrous structure samples in the three-dimensional Cartesian coordinates system. A fibrous structure sample irradiated with X-rays, transmits its radiation for collection into an X-ray scintillator to transform the X-rays into electromagnetic radiations readable by the CCD elements of an array camera. Images are taken from different angles to reconstruct the 3D space. An obtained 3D dataset, the produced volume image, is analyzed via Matlab® image processing software application to determine the relative basis weight, thickness and density of the 3D fibrous structures.

Specified emboss and non-emboss areas of a fibrous structure sample are defined and cut to 20 mm diameter and placed in a custom rotating short sample tube for sample suspension in the micro-tomography instrument. Image acquisition parameters of the 3-D isotropic scan included High resolution (1000 projections) with the x-ray tube set at a current of 180 μA and peak energy of 35 kVp, with a 300 msecond integration time. Averaging is set at 10. A slice increment of approximately 10 μm is acquired (about 200-300 slices depending on sample thickness) over an imaging time of approximately 4-7 hours. Each slice consisting of 1000 projections was used to reconstruct the CT image in a 2048×2048 pixel matrix, with a pixel resolution of 10 μm.

Matlab® Image Analysis is used to analyze the volume image slice by slice to create 2-D images that represent features along the z, or thickness direction, i.e., mass, top layer image, bottom layer image, thickness of sheet, and "volume density" of the sample. The thickness image is selected to draw and measure user defined regions of interest (ROI) to obtain thickness data of the fibrous structure sample. Embossment ROI's are drawn within the center of an embossment away from the embossment wall transition area. Non-emboss areas selected for thickness measurements surrounding the embossment being measured are drawn in polygon form in embossment free-areas of the fibrous structure sample. Average thickness of embossment is the average thickness of the embossment as measured by this method. Average thickness of embossed fibrous structure adjoining the embossment is the average thickness of the embossment free-areas surrounding the embossment.

Embossment Height Test Method

Embossment height is measured using a GFM Primos Optical Profiler instrument commercially available from GFMesstechnik GmbH, Warthestraβe 21, D14513 Teltow/Berlin, Germany. The GFM Primos Optical Profiler instrument includes a compact optical measuring sensor based on the digital micro mirror projection, consisting of the following main components: a) DMD projector with 1024×768 direct digital controlled micro mirrors, b) CCD camera with high resolution (1300×1000 pixels), c) projection optics adapted to a measuring area of at least 27×22 mm, and d) recording optics adapted to a measuring area of at least 27×22 mm; a table tripod based on a small hard stone plate; a cold light source; a measuring, control, and evaluation computer; measuring, control, and evaluation software ODSCAD 4.0, English version; and adjusting probes for lateral (x-y) and vertical (z) calibration.

The GFM Primos Optical Profiler system measures the surface height of a sample using the digital micro-mirror pattern projection technique. The result of the analysis is a map of surface height (z) vs. xy displacement. The system has a field of view of 27×22 mm with a resolution of 21 microns. The height resolution should be set to between 0.10 and 1.00 micron. The height range is 64,000 times the resolution.

To measure a fibrous structure sample do the following:

Turn on the cold light source. The settings on the cold light source should be 4 and C, which should give a reading of 3000K on the display;

Turn on the computer, monitor and printer and open the ODSCAD 4.0 Primos Software.

Select "Start Measurement" icon from the Primos taskbar and then click the "Live Pic" button.

Place a 30 mm by 30 mm sample of fibrous structure product conditioned at a temperature of 73° F.±2° F. (about 23° C.±1° C.) and a relative humidity of 50%±2% under the projection head and adjust the distance for best focus.

Click the "Pattern" button repeatedly to project one of several focusing patterns to aid in achieving the best focus (the software cross hair should align with the projected cross hair when optimal focus is achieved). Position the projection head to be normal to the sample surface.

Adjust image brightness by changing the aperture on the lens through the hole in the side of the projector head and/or altering the camera "gain" setting on the screen. Do not set the gain higher than 7 to control the amount of electronic noise.

When the illumination is optimum, the red circle at bottom of the screen labeled "I.O." will turn green.

Select Technical Surface/Rough measurement type.

Click on the "Measure" button. This will freeze on the live image on the screen and, simultaneously, the image will be captured and digitized. It is important to keep the sample still during this time to avoid blurring of the captured image. The image will be captured in approximately 20 seconds.

If the image is satisfactory, save the image to a computer file with ".omc" extension. This will also save the camera image file ".kam".

To move the date into the analysis portion of the software, click on the clipboard/man icon.

Now, click on the icon "Draw Cutting Lines". Make sure active line is set to line 1. Move the cross hairs to the lowest point on the left side of the computer screen image and click the mouse. Then move the cross hairs to the lowest point on the right side of the computer screen image on the current line and click the mouse. Now click on "Align" by marked points icon. Now click the mouse on the lowest point on this line, and then click the mouse on the highest point on this line. Click the "Vertical" distance icon. Record the distance measurement. Now increase the active line to the next line, and repeat the previous steps, do this until all lines have been measured (six (6) lines in total. Take the average of all recorded numbers, and if the units is not micrometers, convert it to micrometers (μm). This number is the embossment height. Repeat this procedure for another image in the fibrous structure product sample and take the average of the embossment heights.

Flexural Rigidity Test Method

This test is performed on 1 inch×6 inch (2.54 cm×15.24 cm) strips of a fibrous structure sample. A Cantilever Bending Tester such as described in ASTM Standard D 1388 (Model 5010, Instrument Marketing Services, Fairfield, N.J.) is used and operated at a ramp angle of 41.5±±0.5° and a sample slide speed of 0.5±0.2 in/second (1.3±0.5 cm/second). A minimum of n=16 tests are performed on each sample from n=8 sample strips.

No fibrous structure sample which is creased, bent, folded, perforated, or in any other way weakened should ever be tested using this test. A non-creased, non-bent, non-folded, non-perforated, and non-weakened in any other way fibrous structure sample should be used for testing under this test.

From one fibrous structure sample of about 4 inch×6 inch (10.16 cm×15.24 cm), carefully cut using a 1 inch (2.54 cm) JDC Cutter (available from Thwing-Albert Instrument Company, Philadelphia, Pa.) four (4) 1 inch (2.54 cm) wide by 6 inch (15.24 cm) long strips of the fibrous structure in the MD direction. From a second fibrous structure sample from the same sample set, carefully cut four (4) 1 inch (2.54 cm) wide by 6 inch (15.24 cm) long strips of the fibrous structure in the CD direction. It is important that the cut be exactly perpendicular to the long dimension of the strip. In cutting non-laminated two-ply fibrous structure strips, the strips should be cut individually. The strip should also be free of wrinkles or excessive mechanical manipulation which can impact flexibility. Mark the direction very lightly on one end of the strip, keeping the same surface of the sample up for all strips. Later, the strips will be turned over for testing, thus it is important that one surface of the strip be clearly identified, however, it makes no difference which surface of the sample is designated as the upper surface.

Using other portions of the fibrous structure (not the cut strips), determine the basis weight of the fibrous structure sample in lbs/3000 ft2 and the caliper of the fibrous structure in mils (thousandths of an inch) using the standard procedures disclosed herein. Place the Cantilever Bending Tester level on a bench or table that is relatively free of vibration, excessive heat and most importantly air drafts. Adjust the platform of the Tester to horizontal as indicated by the leveling bubble and verify that the ramp angle is at 41.5±0.5°. Remove the sample slide bar from the top of the platform of the Tester. Place one of the strips on the horizontal platform using care to align the strip parallel with the movable sample slide. Align the strip exactly even with the vertical edge of the Tester wherein the angular ramp is attached or where the zero mark line is scribed on the Tester. Carefully place the sample slide bar back on top of the sample strip in the Tester. The sample slide bar must be carefully placed so that the strip is not wrinkled or moved from its initial position.

Move the strip and movable sample slide at a rate of approximately 0.5±0.2 in/second (1.3±0.5 cm/second) toward the end of the Tester to which the angular ramp is attached. This can be accomplished with either a manual or automatic Tester. Ensure that no slippage between the strip and movable sample slide occurs. As the sample slide bar and strip project over the edge of the Tester, the strip will begin to bend, or drape downward. Stop moving the sample slide bar the instant the leading edge of the strip falls level with the ramp edge. Read and record the overhang length from the linear scale to the nearest 0.5 mm. Record the distance the sample slide bar has moved in cm as overhang length. This test sequence is performed a total of eight (8) times for each fibrous structure in each direction (MD and CD). The first four strips are tested with the upper surface as the fibrous structure was cut facing up. The last four strips are inverted so that the upper surface as the fibrous structure was cut is facing down as the strip is placed on the horizontal platform of the Tester.

The average overhang length is determined by averaging the sixteen (16) readings obtained on a fibrous structure.

Overhang Length MD=Sum of 8 MD readings/8

Overhang Length CD=Sum of 8 CD readings/8

Overhang Length Total=Sum of all 16 readings/16

Bend Length MD=Overhang Length MD/2

Bend Length CD=Overhang Length CD/2

Bend Length Total=Overhang Length Total/2

Flexural Rigidity=0.1629×$W$×$C$3 wherein W is the basis weight of the fibrous structure in lbs/3000 $ft^2$; C is the bending length (MD or CD or Total) in cm; and the constant 0.1629 is used to convert the basis weight from English to metric units. The results are expressed in mg-cm, but are referred to only a cm.

Plybond Strength Test Method

Plybond strength is measured according to the following test method.

From a single multi-ply fibrous structure comprising an adhesive that bonds two or more of the plies together cut four (4) 3"×8.2" (76.2 mm×208.3 mm) continuous (i.e., non-perforated) fibrous structure sample strips conditioned with all wrapping and/or packaging materials removed, if necessary, at a temperature of 73° F.±2° F. (about 23° C.±1° C.) and a relative humidity of 50%±2% for two (2) hours. This test method measures the plybond strength between two adjacent plies of the fibrous structure.

The fibrous structure sample strips are prepared by using a cutting die [3"×11" (76.2 mm×279.4 mm)] on a plywood base, commercially available from Acme Steel Rule Corp., 5 Stevens St., Waterbury, Conn. 06714. The cutting die must be modified with a soft foam rubber insert material. A JDC Cutter 3" (76.2 mm), Model #JDC-3-12 Precision Sample Cutter, Thwing-Albert Instrument Company, 10960 Dutton Road, Philadelphia, Pa. 19154, having a side capacity to cut 3"×8.2" (76.2 mm×208.3 mm) fibrous structure sample strips is used to cut the fibrous structure samples. The 3" (76.2 mm) wide strip are cut from the center of the fibrous structure. The strips are cut in the MD direction of the fibrous structure. If the fibrous structure is in roll form, cut the samples from greater than 40" (1016 mm) from the ends of the roll.

Individually take each sample strip and gently manually initiate ply separation along the MD direction and continuing for 2" (50 mm).

Do not use samples that contain obvious defects, such as wrinkles, creases, tears, holes, etc.

The measuring of the samples and the preparation of the samples should all occur in a conditioned environment at a temperature of 73° F.±2° F. (about 23° C.±1° C.) and a relative humidity of 50%±2%.

A Thwing-Albert EJA or Intelect-II-STD, Cat. No. 1451-24PG; Thwing-Albert Instrument Company tensile tester is used to measure the plybond strength of the samples. The tensile tester has general purpose air-operated grips (Cat. No. 734K) with 1"×3" (25.4 mm×76.2 mm) inserts. The load cell of the tensile tester is 5000 g. The Sample Size Setting (Load Divider) is set to 3. The tensile tester is operated as follows:

1. Place one of the separated plies of the prepared sample strip in the top grid of the tensile tester. The other ply is placed in the bottom grid. The sample strip needs to be centered in the grips and straight.
2. Activate the tensile tester. When the test is complete, record the value for the load mean. Remove the sample strip from the grips and discard. Check the load cell for a zero reading.
3. Repeat steps 1 and 2 for each sample strip.

The tensile tester will display a value for load mean in g/in (g/25.4 mm). Take the average of four (4) sample strips to obtain the plybond strength of the fibrous structure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A rolled web of cellulosic paper, the rolled web having a machine direction and a cross direction, said rolled web comprising, a. at least a first and a second visually distinct repeating emboss pattern of machine direction oriented embossments, each said repeating emboss pattern comprising,
   i. a first region comprising a first emboss design and a first width;
   ii. a second region comprising a second emboss design and a second width;
   iii. a third region disposed between and contiguous with said first and second regions, said third region comprising a third emboss design and a third width;

b. each said repeating emboss pattern having a repeat pattern width, said repeat pattern width being measured in said cross direction of said rolled web, said repeat pattern width being the sum of said first, second, and third widths of said repeating emboss pattern;

c. said first repeating emboss pattern being parallel and separated from said second repeating emboss pattern in said cross direction, said separation being by a fourth region having a fourth width in said cross direction, said fourth width being greater than said pattern width.

2. The rolled web of claim 1, wherein said rolled web of cellulosic paper is a multiply paper product.

3. The rolled web of claim 2, wherein said at least one of said plies of said multiply paper product is not embossed.

4. The rolled paper web of claim 1, wherein said repeat pattern width is between about 25 mm (1 inch) and about 125 mm (5 inches).

5. The rolled paper web of claim 1, wherein said fourth width is between about 100 mm (4 inch) and about 400 mm (16 inches).

6. The rolled paper web of claim 1, wherein said pattern and fourth width together is between about 125 mm (5 inches) to about 400 mm (16 inches).

7. The rolled paper web of claim 1 wherein said paper is through air dried.

8. The rolled paper web of claim 1 wherein said paper is uncreped.

9. The rolled paper web of claim 1 wherein said first, second and third regions are separated from each other by a distinct continuous emboss pattern.

10. The rolled paper web of claim 9 wherein said distinct continuous emboss pattern is substantially linear in the machine direction, and said distinct continuous emboss pattern comprises uniformly spaced discrete embossments selected from the group consisting of line embossments, point embossments, and combinations thereof.

11. The rolled paper web of claim 1, wherein said cellulosic paper comprises non-embossed wet-formed three-dimensional elements and said third emboss design comprises emboss elements having a maximum dimension of between 20% and 195% of a maximum dimension of said non-embossed wet-formed three-dimensional elements.

12. The rolled paper web of claim 1, wherein said cellulosic paper comprises at least two plies and said third region comprises emboss adhesive that bonds together said at least two plies.

13. The rolled paper web of claim 1, wherein said first region and said second region comprise identical emboss patterns.

14. A rolled web of cellulosic paper, the rolled web having first and second roll edges, a machine direction and a cross direction, said rolled web comprising, a. a first region comprising a first emboss design and a first width measured in said cross direction of said rolled web and a second region comprising a second emboss design and a second width measured in said cross direction of said rolled web;

b. said first region being parallel to and inboard from said first roll edge of said rolled web;

c. said second region being parallel to and inboard from said second edge of said rolled web;

d. a third region comprising a third emboss design, a portion of said third region being disposed between said first edge and said first region, and a portion of said third region being disposed between said second edge and said second region;

e. wherein a cross directional distance measured from said first roll edge to an inboard edge of said first width is less than about 3 inches.

15. The rolled web of claim 14, wherein said first width or said second width is less than about 2 inches.

16. The rolled web of claim 14, wherein said roll comprises a fourth region between said first and second regions, said fourth region comprising a fourth emboss design.

17. The rolled web of claim 15, wherein said fourth emboss design is different from said first or second emboss designs.

18. A rolled web of multi-ply cellulosic paper, the rolled web having first and second roll edges, a machine direction and a cross direction, said rolled web comprising, a. a first region comprising a first emboss design and a first width measured in said cross direction of said rolled web and a second region comprising a second emboss design and a second width measured in said cross direction of said rolled web, said first and second emboss designs comprising at least two different size emboss elements, with at least one emboss element being at least 50% greater than another emboss element;

b. said first region being parallel to and inboard from said first roll edge of said rolled web;

c. said second region being parallel to and inboard from said second edge of said rolled web;

d. a third region comprising a third emboss design, a portion of said third region being disposed between said first edge and said first region, and a portion of said third region being disposed between said second edge and said second region, said third emboss design comprising small emboss elements that adhere plies of said multi-ply cellulosic paper near said first and second roll edges;

e. a fourth region between said first and second regions, said fourth region comprising a fourth emboss design, said fourth emboss design being comprised of an open pattern of unembossed area being bounded and defined by a linear or curvilinear series of small point embossments; and f. wherein a cross directional distance measured from said first roll edge to an inboard edge of said first width is less than about 3 inches and said fourth region has a fourth width measured in the cross machine direction of less than about 10 inches.

19. The multi-ply cellulosic paper of claim 18, wherein said first and second region emboss designs comprise a machine direction oriented, uniformly spaced series of relatively large emboss elements and at least one machine direction oriented, uniformly spaced series of relatively small emboss elements.

20. The multi-ply cellulosic paper of claim 19, wherein said machine direction oriented, uniformly spaced series of relatively small emboss elements is a series of relatively closely spaced, generally round or oval dot embossments.

* * * * *